United States Patent [19]

Roche et al.

[11] 4,268,780

[45] May 19, 1981

[54] INTEGRATED FLUORESCENT-INCANDESCENT LAMP ASSEMBLY

[75] Inventors: William J. Roche, Merrimac; Tadius T. Sadoski, Salem, both of Mass.

[73] Assignee: GTE Products Corporation, Stamford, Conn.

[21] Appl. No.: 135,382

[22] Filed: Mar. 28, 1980

[51] Int. Cl.[3] ..... H05B 41/18; H05B 35/00

[52] U.S. Cl. ..... 315/179; 315/49; 315/100; 315/DIG. 5

[58] Field of Search ..... 315/49, 94, 99, 100, 315/178, 179, 182, 185 R, 250, DIG. 5; 313/1

[56] References Cited

U.S. PATENT DOCUMENTS

| | | | |
|---|---|---|---|
| 2,344,122 | 3/1944 | Bay et al. | 315/49 |
| 2,372,857 | 4/1945 | Setchell | 315/179 X |
| 2,491,881 | 12/1949 | Van Liempt | 315/49 |
| 2,644,108 | 6/1953 | Claude | 315/179 X |
| 3,878,416 | 4/1975 | Roche et al. | 313/3 |

FOREIGN PATENT DOCUMENTS

| | | | |
|---|---|---|---|
| 25814 | 1/1937 | Australia | 315/179 |
| 502367 | 3/1939 | United Kingdom | 315/49 |

*Primary Examiner*—Eugene R. LaRoche
*Attorney, Agent, or Firm*—William H. McNeill

[57] ABSTRACT

A lamp assembly (10) comprises a base plate (12) having both an incandescent bulb (18) and a fluorescent bulb (16) affixed thereto. The incandescent bulb (18) acts as ballast and light source. A glow switch (26) and capacitor (27) act as starter and are contained within the base plate (12) or socket means (14). A starting aid (24) is impedance coupled into the series filament network.

3 Claims, 3 Drawing Figures

INTEGRATED FLUORESCENT-INCANDESCENT LAMP ASSEMBLY

TECHNICAL FIELD

This invention relates to light providing devices and more particularly to an integrated fluorescentincandescent lamp assembly which employs the incandescent lamp as a ballast for the fluorescent lamp.

BACKGROUND ART

Resistive ballasting for fluorescent lamps is known; however, its use is generally avoided because of the low efficiency of the system since the ballast power is radiated as heat. The use of an incandescent lamp for ballast purposes is also known as shown in U.S. Pat. Nos. 2,344,122 and 3,878,416. In the latter instances, the incandescent light and fluorescent light do not have the same or approximate geometric center for the source of the light.

DISCLOSURE OF INVENTION

Therefore, it is an object of this invention to enhance lighting sources.

It is another object of the invention to provide a combination incandescent-fluorescent lamp.

These objects are accomplished, in one aspect of the invention, by the provision of a lamp assembly which has a base plate having thereon socket means for attachment to a source of power. A "U" shaped fluorescent bulb is attached to the base plate as is an incandescent bulb, the latter being positioned between the legs of the fluorescent bulb. The basic starting circuitry including a glow switch and associated RFI suppressor is contained in the socket means. The glow switch is serially connected in a filament loop which comprises the first and second filaments of the fluorescent bulb and the filament of the incandescent bulb. A starting aid is positioned externally of the bulbs and is physically attached to the fluorescent bulb. Electrically, the starting aid is impedance coupled to one side of the filament loop.

This lamp assembly provides many advantages over the prior art. The bulbs are both positioned on a common base and may be individually replaceable. They provide a plural light source having substantially the same geometric center and all necessary circuitry is self-contained. And, the entire unit is useable in standard incandescent lamp fixtures.

BEST MODE FOR CARRYING OUT THE INVENTION

For a better understanding of the present invention together with other and further objects, advantages and capabilities thereof, reference is made to the following disclosure and appended claims taken in conjunction with the above-described drawings.

Figure 1:
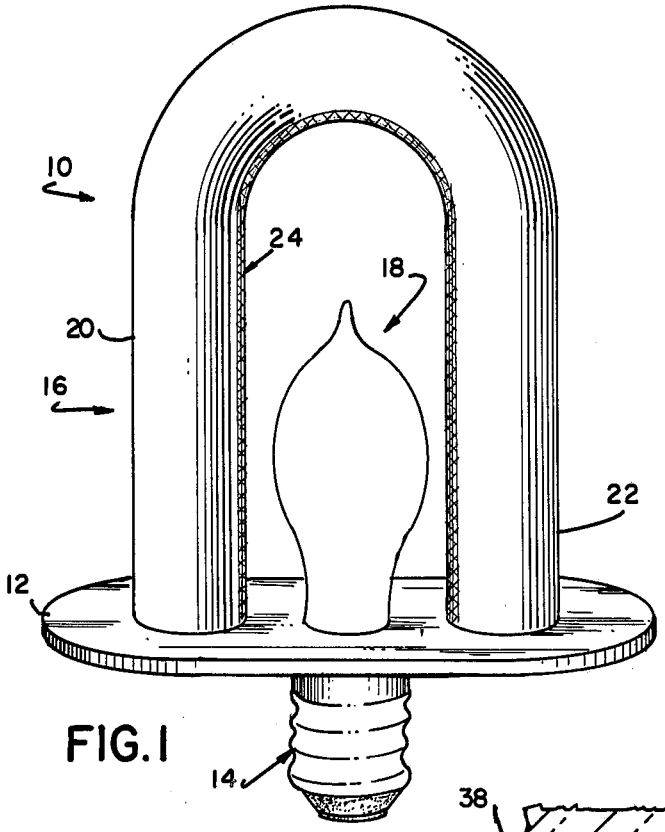
FIG. 1 is a perspective view of the lamp assembly of the invention.
Figure 3:
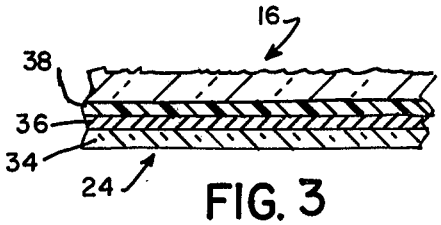
FIG. 3 is a partial, sectional view of the starting aid.

Referring now to the drawings with greater particularity, there is shown in FIG. 1 a lamp assembly 10 having a base plate 12 with socket means 14 affixed thereto. A fluorescent bulb having the form of an inverted "U" is mounted on base plate 12 and an incandescent bulb 18 is mounted between the legs 20 and 22 of fluorescent bulb 16, also on base plate 12. The bulbs 16 and 18 can be permanently fixed to the base plate or they can be removably mounted, as by providing base plate 12 with suitable socket connections. A starting aid 24 in the form of field enhancing means is externally attached to bulb 16, and is impedance connected to the starting and operating circuitry, as will be more fully explained below.

Fluorescent bulb 16 can have an arc length of 15 inches and an outside diameter of 1 inch and preferably has its inside wall coated with a high efficiency, high color rendering phosphor. Bulb 16 can be bent and processed in a conventional manner and be filled with argon gas to a pressure of 3 Torr and contain a suitable amount of mercury to provide an effective mercury vapor pressure, as is well known. Bulb 16 further contains the usual pair of cathode filaments $f_1$ and $f_2$, one at each end thereof.

Figure 2:
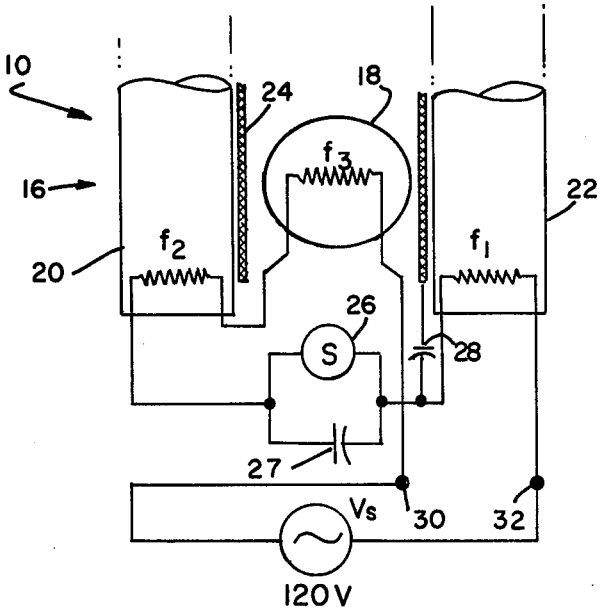
FIG. 2 is a diagram of the starting and operating circuitry.

The circuitry for lamp assembly 10 is shown in FIG. 2 and comprises, in addition to filaments $f_1$ and $f_2$ of bulb 16 the filament $f_3$ of incandescent bulb 18, glow switch 26 and shunting capacitor 27 (which functions as an RFI suppressor during operation) and impedance 28, which can be a capacitor or resistor, which connects starting aid 24 to the filament loop circuit.

In operation a 120 V A.C. source is applied across socket contacts 30 and 32. This establishes a current in the serially connected filament loop comprised of filament $f_1$, glow switch 26, filament $f_2$ and incandescent ballast filament $f_3$.

Initially the current will be low due to the high impedance of the starter; however, the current will increase drastically when the starter impedance becomes shorted out due to the internal operation thereof. The increased circuit current is effective to raise the temperature of fluorescent filaments $f_1$ and $f_2$ to the proper level for starting, which will occur when the starter reverts back to its high impedance mode.

Since the ballasting is resistive there is no starting pulse generated in the circuit as would be the case if an inductive choke were employed. To compensate for this lack, starting aid 24 is used as a field enhancing means. Starting aid 24 is tripartite or three layered and is comprised of a suitable plastic or other electrically insulating strip 34, about ¼ inch wide, such as Mylar. A metallized middle layer 36 is attached to strip 34. The other side of layer 36 carries an adhesive 38 which is fixed to the surface of fluorescent bulb 16 along the inside of the "U". One end of starting aid 24 is impedance coupled, as by capacitor 28, to one side of the filament loop.

After the fluorescent lamp has ignited, the circuit current loop will comprise filament $f_1$, bulb 16, filament $f_2$ and filament $f_3$. The starter (glow switch 26) will remain in a high impedance mode once the lamp 16 has ignited and as long as the lamp voltage remains below 65 volts. Capacitor 27, which shunts the starter 26, functions as an RFI suppressor during lamp operation.

The incandescent bulb 18 should be selected on the basis of voltage and current compatibility with fluorescent bulb 16. Since bulb 18 is being employed as ballast, it must be able to operate non-destructively during the preheating mode prior to fluorescent lamp ignition, during which time it must absorb about 100 volts. During fluorescent lamp operation this voltage will drop to about 60 volts. Proper design of incandescent filament $f_3$ therefore will dictate a filament rating of 100 volts with a wattage rating determined by the preheat requirement of the fluorescent filaments. The reduced voltage during lamp operation will increase the rated life of the incandescent filament by at least a factor of $10^2$. However, the lumen output of the incandescent bulb will be reduced to 20% of its design rating at the reduced operating voltage. Despite the reduced lumen output of the incandescent bulb, lamp assembly 10 still provides a 200 lumen gain in light output relative to non-incandescent resistive ballasting.

The starter used will, of course, depend upon the length and diameter of the fluorescent lamp. With the fluorescent bulb described above it is preferred to use an FS-25 starter shunted with a 0.001 $\mu$f capacitor.

Base plate 12 can be made of metal, plastic or any other convenient material. The threaded socket means 14 is of the type normally employed for incandescent bulbs designed for household use and has an interior space large enough to accommodate starter 26 and capacitor 27. Of course, if some other type of socket means 14 is desired, such as a bipin or wall-socket type of male connector, the base plate 12 can be enlarged to receive starter 26 and capacitors 27 and 28.

A lamp assembly 10 constructed in accordance with the teachings contained herein developed the following performance data:

| | |
|---|---|
| Line Voltage | 120V A.C. |
| Lamp Current | 370 mA |
| Lamp Power | 42 Watts |
| Lamp Output | 1000 Lumens |
| Lamp Efficacy | 23.8 l/w |
| Lamp Power Factor | 0.95 |

It can be seen from the above that lamp assemblies as described herein provide a unique light source. They are efficient and economical to construct and operate and provide a balanced light output. When one or both bulbs are interchangeable many combinations of color are available. The location of the incandescent bulb 18 between the legs of the fluorescent bulb 16 means that the hotter operating incandescent is shielded by the cooler operating fluorescent.

All of these features provide a unique advance in the art.

While there have been shown and described what are at present considered to be the preferred embodiments of the invention, it will be apparent to those skilled in the art that various changes and modifications can be made herein without departing from the scope of the invention as defined by the appended claims.

We claim:

1. A lamp assembly comprising:

a base plate having thereon socket means for connection to a source of power;

a "U" shaped fluorescent bulb affixed to said base plate;

an incandescent bulb affixed to said base plate between the legs of said fluorescent bulb;

a glow switch and associated RFI suppressor contained within said socket means, said glow switch being serially connected in a filament loop comprising: the first and second filaments of said fluorescent bulb and the filament of said incandescent bulb; and a starting aid positioned externally of said bulbs and attached to said fluorescent bulb, said starting aid being impedance coupled to one side of said filament loop.

2. The lamp assembly of claim 1 wherein said starting aid comprises a tripartite strip having, in order, an adhesive layer which is electrically insulating, a metal layer, and a non-adhesive, electrically insulating layer, said adhesive layer being affixed to said fluorescent bulb.

3. The lamp assembly of claim 2 wherein said starting aid is affixed to the surface of said fluorescent bulb facing said incandescent bulb.

* * * * *